United States Patent [19]

Desjardins

[11] Patent Number: 4,739,861

[45] Date of Patent: Apr. 26, 1988

[54] OIL FILLER ADAPTER

[76] Inventor: Warren Desjardins, 128 Engelke St., Patchogue, N.Y. 11772

[21] Appl. No.: 847,662

[22] Filed: Apr. 3, 1986

[51] Int. Cl.[4] ..... F16N 33/00; B65B 3/04; B65D 47/00; F16K 51/00

[52] U.S. Cl. ..... 184/1.5; 184/105.1; 141/330; 222/83; 222/549; 251/144; 7/100

[58] Field of Search ..... 184/1.5, 105.1; 81/177.1, 177.2, 177.8; 7/100, 138, 165, 170; 141/330, 1, 9, 329; 222/88, 552, 83, 83.5, 549; 251/144

[56] References Cited

U.S. PATENT DOCUMENTS

| | | | |
|---|---|---|---|
| 170,093 | 11/1875 | Landon | 141/344 |
| 2,002,611 | 5/1938 | Nall | 141/330 |
| 2,134,004 | 10/1938 | Pittman | 184/105.1 |
| 2,373,774 | 4/1945 | Murnane | 222/83 |
| 2,450,461 | 10/1948 | Wallach | 222/83 |
| 2,464,058 | 3/1949 | Rogers | 7/138 |
| 2,585,526 | 2/1952 | Zautner | 7/165 |
| 2,588,541 | 3/1952 | Kuehn | 222/83 |
| 2,655,286 | 10/1953 | Barbaro | 222/88 |
| 2,688,428 | 9/1954 | Manhartsberger | 222/83 |
| 2,744,656 | 5/1956 | Hope | 222/88 |
| 3,020,790 | 2/1962 | Davis | 81/177.1 |
| 3,024,044 | 3/1962 | Benevento | 141/330 |
| 3,730,224 | 5/1973 | Prisk | 251/144 |
| 3,777,789 | 12/1973 | Corlet | 141/329 |
| 3,828,981 | 8/1974 | Linkletter | 222/549 |
| 3,990,489 | 11/1976 | Ruter | 184/105.1 |
| 4,106,701 | 8/1978 | Siefken | 141/329 |

FOREIGN PATENT DOCUMENTS

| | | | |
|---|---|---|---|
| 558401 | 8/1923 | France | 141/330 |

*Primary Examiner*—Carlton R. Croyle
*Assistant Examiner*—Jane E. Obee
*Attorney, Agent, or Firm*—Richard L. Miller

[57] ABSTRACT

An oil filler adapter comprising a container for holding oil, a piercing tube which punctures the can of oil and a flow tube which connects with the oil inlet part of fill tube of an engine. The piercing tube acts as a seal with the container when the oil is initially disposed in the container. When the tube is rotated by inserting a cap into a slot in the tube, the seal is broken.

8 Claims, 1 Drawing Sheet

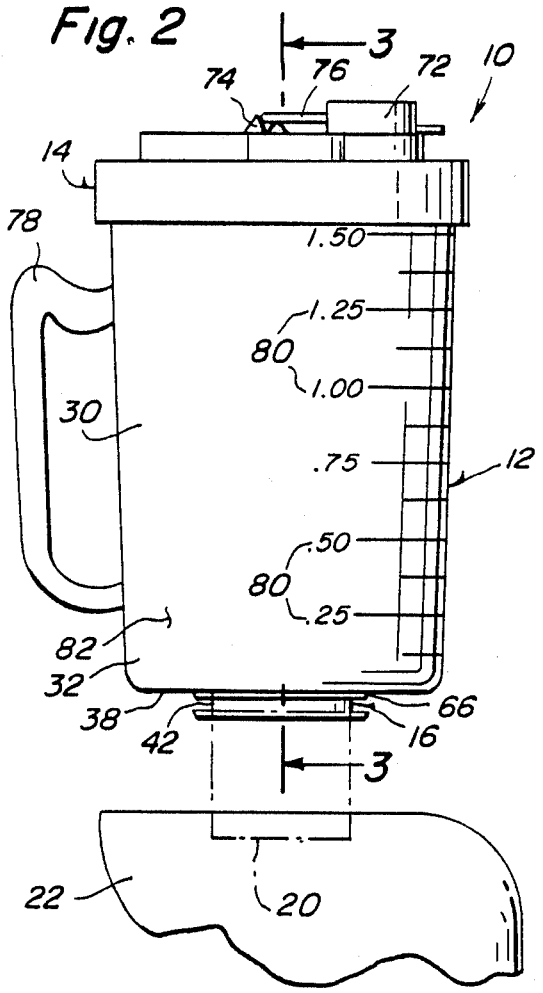
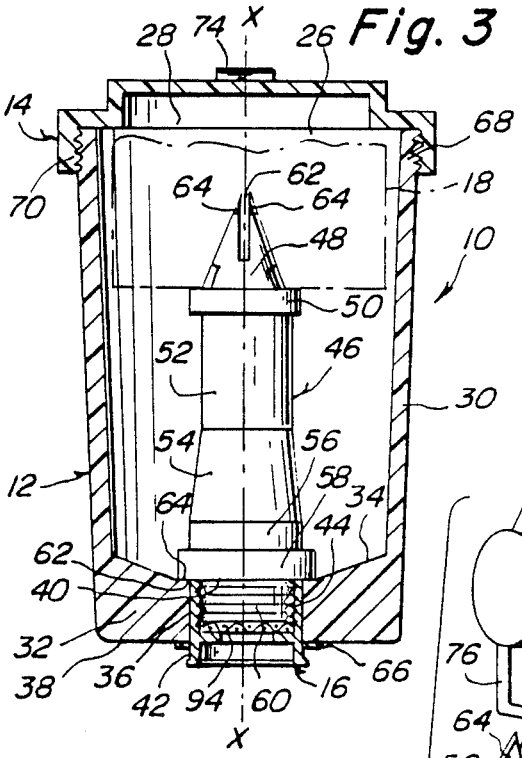
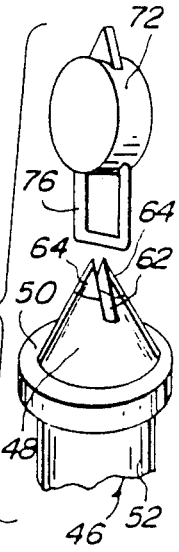
Fig. 5
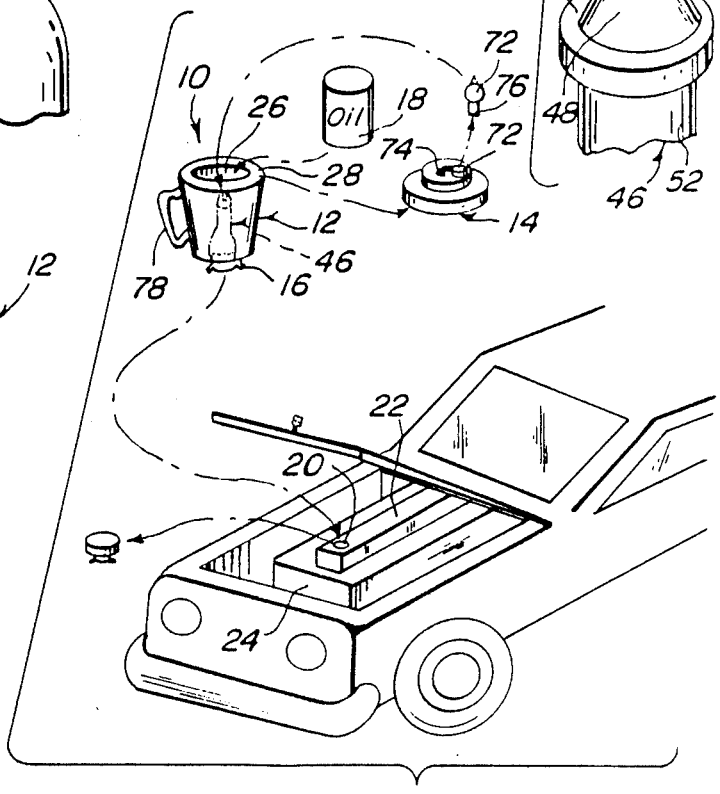
Fig. 1
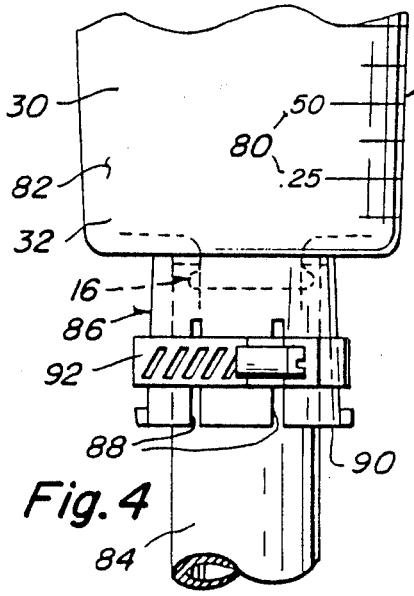
Fig. 4

OIL FILLER ADAPTER

BACKGROUND OF THE INVENTION

This invention relates to fillers; and more particularly to an oil filler adapter.

The transfer of liquids from a container to an opening or pipe leading to a tank or other holding enclosure is a cumbersome operation. Often funnels, spouts and other hollow cones are used for filling vessels with a narrow inlet. When the liquid is motor oil being poured into an oil filler pipe or the inlet part in the valve cover of an engine the splashing of oil onto the engine, valve cover or near by parts should be avoided. The use of funnels for pouring from the can directly into a filler hole allows for a high probability of spillage and/or splashing. The result may be smoking and possible damage to components surrounding the engine in the case of motor oil being poured into the engine oil inlet. None of the existing methods seem to provide a drip and splash proof method for transfer of motor oil to an engine.

SUMMARY OF THE INVENTION

It is therefore an object of this invention to provide a new and improved filler.

It is another object of this invention to provide a new and improved oil filler.

It is yet another object of this invention to provide a new and improved oil filler adapter for engines.

It is further object of this invention to provide a new and improved oil filler adapter with a wrench device.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view illustrating the invention in use.

FIG. 2 is a side elevational view of the invention ready to be connected to an oil inlet port on the valve cover of an engine.

FIG. 3 is a cross sectional view taken along line 3—3 in FIG. 1.

FIG. 4 is a side elevational view with parts broken away of a modification showing a downwardly extending neck securement to an oil filler pipe of an engine.

FIG. 5 is a perspective the cap being used as a wrench to loosen puncture device so that oil contained in the instant invention may pour through bottom thereof.

DESCRIPTION OF THE PREFERRED EMBODIMENT

With reference to FIGS. 1–3 there is generally shown an oil filler adapter 10. Adapter 10 includes a container 12, a cover 14 and a flow tube 16. An oil can 18 (FIG. 1) is placed inside container 12 flow tube 16 is positioned with an oil inlet port 20 on a valve cover 22 of an engine 24.

Container 12 is essentially of a cylindrical form of predetermined length and diameter to accommodate placement of oil can 18 therein. An opening 26 of predetermined diametral size is located proximate a top edge 28 of container 12. A wall 30 extends from top edge 28 at a constant thickness to juncture with a base 32. Base 32 has an internal surface 34, which forms a truncated cone concentric with wall 30. A hole 36 positioned in base 32 in the form of a cylinder is concentric with wall 30 and concentric with a central axis of symmetry x—x (FIG. 3) of container 12. Hole 36 extends through base 32 from a bottom surface 38 to internal surface 34, with a predetermined diameter 40, surface 34 slopes downward to hole 36. Flow tube 16 is essentially a cylindrical tube with an outside diameter 42 of a predetermined size to coact with diameter 40 of hole 36 as a press fit with an internal thread 44 concentric to diameter 42. A piercing rod 46 is provided with a top portion 48 essentially conical in form an upper flange portion 50 an upper body portion 52 cylindrical in form, a middle body portion 54 in the form of a truncated cone, a lower body portion 56 cylindrical in form, a bottom flange 58 and a threaded portion 60 with external threads. All the parts of rod 46 are concentric to each other and axis of symmetry x—x. A slot 62 of predetermined length and width is disposed at the apex of the cone of top 48 a pair of inserts 64 proximate the apex of top 48 are each essentially in the form of a pyramid. Inserts 64 are steel, hardened aluminum or other like material. Materials of construction of rod 46, container 12, flow tube 16 and cover 14 are plastic, aluminum or like material. Threaded portion 60 of rod 46 coact with internal thread 44 of container 12. A second portion 62 of internal surface 34 forms a plane parallel to bottom 38 which coacts with a bottom surface 64 of flange 58. A gasket 66 is affixed by glueing or other conventional methods to bottom 38 with a internal diameter of predetermined size to coact with diameter 42 of flow tube 16.

Proximate edge 28 of conainer 12 is disposed as an external thread 68 which coacts with an internal thread 70 of cover 14. Cover 14 is conventional and includes a cap 72 and a snap 74. Cap 72 has affixed a wand 76 in the form of a U (FIG. 5).

A handle 78 is affixed to conainer 12 (FIG. 2). A series of volumetric scales 80 disposed on an outer surface 82 by moulding, printing or the like.

An alternative form of connecting flow tube 16 to a filler pipe 84 is shown in FIG. 4. Flow tube 16 seats into an extending neck 86. Neck 86 is tubular with a plurality of longitudinal slots 88 disposed around the periphery of neck 86 extending from a bottom surface 90 of neck 86. A clamp 92 secures neck 86 to filler pipe 84.

METHOD OF OPERATION

Once cover 14 is removed, oil can 18 is pushed over piercing tube 46 and the oil flows into container 12. Cap 72 is removed from snap 74 and wand 76 is positioned in slot 62. Flow tube 16 is positioned into inlet port 20 and secured by twisting. Cap 72 is used as a wrench to rotate threads 60 of rod 46 in threads 44 of tube 16 creating an opening between surface 64 and surface 62 allowing the flow of oil through the space between the internal thread 44 and the external threaded portion 50 when tube 46 is partially unscrewed and then through tube 16, or when the tube 46 is completely unscrewed, directly into tube 16 into the engine 24. A strainer 94 is provided to filter any particle from the oil.

While the certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An oil filler adaptor comprising (a) a container having an internal cavity constructed to receive a can containing oil;

(b) a piercing rod carried essentially central to said internal cavity of said container for piercing an oil can so that oil will flow into and remain stored in said container;

(c) a flow tube carried by said container for directing oil disposed in said container into a receiver; and (d) means on said piercing rod threadedly closing onto said flow tube for controlling opening and closing of said flow tube to permit the flow of oil from the container into the receiver.

2. The oil filler adapter of claim 1, wherein said flow tube is of predetermined size to fit within an inlet part of an engine.

3. The oil filler adaptor of claim 2, wherein said piercing rod comprises a rotatable sealing end having a first disposition which prevents oil flow from said container and a second disposition which allows flow from said container into said flow tube.

4. The oil filler adapter of claim 3, wherein a first portion of said piercing rod is conical in form.

5. The oil filler adapter of claim 4, wherein said first portion has a vertical slot.

6. The oil filler adapter of claim 5, wherein a cover for said container includes a detachable cap.

7. The oil filler adapter of claim 6, wherein said cap when disposed in said slot is used as a wrench to change the disposition of said piercing rod.

8. The oil filler adapter of claim 7, wherein said flow tube is disposed in a neck having a strainer, said neck being of a predetermined size to affix to an oil filler pipe where by oil passing through said neck is filtered by said strainer.

* * * * *